US011047575B2

(12) United States Patent
Eastwood et al.

(10) Patent No.: US 11,047,575 B2
(45) Date of Patent: Jun. 29, 2021

(54) COMBUSTOR HEAT SHIELD PANEL

(71) Applicant: United Technologies Corporation, Farmington, CT (US)

(72) Inventors: Jonathan Jeffery Eastwood, West Hartford, CT (US); Jon E. Sobanski, Glastonbury, CT (US); Steven D. Porter, Wethersfield, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 50 days.

(21) Appl. No.: 16/383,999

(22) Filed: Apr. 15, 2019

(65) Prior Publication Data

US 2020/0326072 A1 Oct. 15, 2020

(51) Int. Cl.
*F23R 3/00* (2006.01)
*F23R 3/06* (2006.01)

(52) U.S. Cl.
CPC ..... *F23R 3/06* (2013.01); *F23R 2900/00017* (2013.01); *F23R 2900/03041* (2013.01); *F23R 2900/03043* (2013.01)

(58) Field of Classification Search
CPC ..... F23R 3/34; F23R 3/42; F23R 3/50; F23R 3/60; F23R 3/002; F23R 3/06; F23R 2900/00015; F23R 2900/00017
See application file for complete search history.

(56) References Cited

U.S. PATENT DOCUMENTS 7,350,360 B2 4/2008 Graf et al.
9,970,660 B2 * 5/2018 Chandler ..... F23R 3/10
2004/0159106 A1 * 8/2004 Patel ..... F23R 3/06 60/798
2005/0086940 A1 * 4/2005 Goughian ..... F23R 3/002 60/752
2006/0179770 A1 * 8/2006 Hodder ..... F23M 5/02 52/588.1
2010/0037621 A1 * 2/2010 Tschuor ..... F23R 3/54 60/752

(Continued)

FOREIGN PATENT DOCUMENTS

EP 3306195 A2 4/2018
EP 3321584 A1 5/2018

(Continued)

OTHER PUBLICATIONS

The Extended European Search Report for Application No. 20169695.2-1009; Report Issued Date: Aug. 18, 2020; Report Received Date: Sep. 10, 2020; 6 pages.

*Primary Examiner* — Todd E Manahan
*Assistant Examiner* — Edwin Kang
(74) *Attorney, Agent, or Firm* — Cantor Colburn LLP

(57) ABSTRACT

A combustor for use in a gas turbine engine, the combustor enclosing a combustion chamber having a combustion area. The combustor includes: a shell having a kink; and a kinked heat shield panel in facing spaced relationship with the shell, the kinked heat shield panel including a kink located proximate the kink in the shell, wherein the kinked heat shield panel further includes a first surface, a second surface opposite the first surface, and a mounting stud located proximate the kink of the kinked heat shield panel and extending away from the second surface.

16 Claims, 6 Drawing Sheets

(56) References Cited

U.S. PATENT DOCUMENTS

| | | | | |
|---|---|---|---|---|
| 2010/0263386 | A1* | 10/2010 | Edwards | F23R 3/002 60/796 |
| 2011/0011095 | A1* | 1/2011 | Ladd | F23R 3/60 60/796 |
| 2015/0096302 | A1 | 4/2015 | Herborth | |
| 2016/0208704 | A1* | 7/2016 | Bouldin | F23R 3/002 |
| 2016/0313005 | A1* | 10/2016 | Chang | F23R 3/60 |
| 2018/0231248 | A1 | 8/2018 | Burd | |
| 2018/0231249 | A1 | 8/2018 | Burd | |

FOREIGN PATENT DOCUMENTS

| | | | |
|---|---|---|---|
| EP | 3321585 | A1 | 5/2018 |
| GB | 2432902 | A | 6/2007 |
| WO | 2018182807 | A1 | 10/2018 |

* cited by examiner

COMBUSTOR HEAT SHIELD PANEL

BACKGROUND

The subject matter disclosed herein generally relates to gas turbine engines and, more particularly, to a method and apparatus for mitigating heat in cooling surfaces of gas turbine engines using heat shield panels.

In one example, a combustor of a gas turbine engine may be configured to burn fuel in a combustion area. Such configurations may place substantial heat load on the structure of the combustor (e.g., heat shield panels, shells, etc.). Such heat loads may dictate that special consideration is given to structures, which may be configured as heat shields or panels, and to the cooling of such structures to protect these structures. Excess temperatures at these structures may lead to oxidation, cracking, and high thermal stresses of the heat shields panels.

SUMMARY

According to an embodiment, a combustor for use in a gas turbine engine is provided. The combustor enclosing a combustion chamber having a combustion area, wherein the combustor includes: a shell having a kink; and a kinked heat shield panel in facing spaced relationship with the shell, the kinked heat shield panel including a kink located proximate the kink in the shell, wherein the kinked heat shield panel further includes a first surface, a second surface opposite the first surface, and a mounting stud located proximate the kink of the kinked heat shield panel and extending away from the second surface.

In addition to one or more of the features described above, or as an alternative, further embodiments may include that the kinked heat shield panel is parallel to the shell.

In addition to one or more of the features described above, or as an alternative, further embodiments may include that the combustor includes a first section and a second section, wherein the kink of the shell is a junction of a first section of the combustor having a first coned shape and the second section of the combustor having a second coned shape.

In addition to one or more of the features described above, or as an alternative, further embodiments may include that the kink of the shell is a point in the shell at which the cross sectional area of the combustor changes.

In addition to one or more of the features described above, or as an alternative, further embodiments may include that the shell further includes an inner surface, an outer surface opposite the inner surface, and a mounting orifice extending through the shell from the inner surface to the outer surface, the mounting orifice being located proximate the kink of the shell.

In addition to one or more of the features described above, or as an alternative, further embodiments may include that the mounting orifice is located at or on the kink of the shell.

In addition to one or more of the features described above, or as an alternative, further embodiments may include that the mounting stud is located at or on the kink of the kinked heat shield panel.

In addition to one or more of the features described above, or as an alternative, further embodiments may include that the shell further includes an inner surface, an outer surface opposite the inner surface, and a mounting orifice extending through the shell from the inner surface to the outer surface, the mounting orifice being located proximate the kink of the shell, and wherein the mounting orifice is located opposite the mounting stud.

In addition to one or more of the features described above, or as an alternative, further embodiments may include that the kinked heat shield panel further includes a forward edge, a rearward edge opposite the forward edge, a first lateral edge, and a second lateral edge opposite the first lateral edge, wherein the first lateral edge and the second lateral edge extend from the forward edge to the rearward edge, and wherein the kink of the kinked heat shield panel extends from the first lateral edge to the second lateral edge.

In addition to one or more of the features described above, or as an alternative, further embodiments may include that the kink of the kinked heat shield panel extends from the first lateral edge to the second lateral edge about parallel to at least one of the forward edge and the rearward edge.

In addition to one or more of the features described above, or as an alternative, further embodiments may include that the kinked heat shield panel further includes a locating pin located proximate the mounting stud and extending away from the second surface, wherein the locating pin further includes a platform surface operably shaped to conform to the inner surface of the shell opposite the locating pin.

In addition to one or more of the features described above, or as an alternative, further embodiments may include: a nut secured to the mounting stud; and a kinked washer interposed between the nut and the outer surface of the shell, the kinked washer being operably shaped to conform to the outer surface of the shell proximate the kink of the shell.

In addition to one or more of the features described above, or as an alternative, further embodiments may include that the kinked washer further includes a first surface proximate the outer surface of the shell and a second surface opposite the first surface, the second surface being proximate the nut, and wherein the first surface of the kinked washer is operably shaped to conform to the outer surface of the shell proximate the kink of the shell.

In addition to one or more of the features described above, or as an alternative, further embodiments may include that the second surface of the kinked washer is operably shaped to conform to the nut.

In addition to one or more of the features described above, or as an alternative, further embodiments may include that the kinked washer further includes a receiving orifice extending through the kinked washer from the first surface to the second surface, the mounting stud being located within the kinked orifice.

In addition to one or more of the features described above, or as an alternative, further embodiments may include that the mounting orifice is circular, oval or slotted in shape.

In addition to one or more of the features described above, or as an alternative, further embodiments may include that the kinked heat shield panel further includes a first surface, a second surface opposite the first surface, and a mounting stud located proximate the kink of the kinked heat shield panel and extending away from the second surface, and wherein the mounting stud is located proximate at least one of the first lateral edge and the second lateral edge.

In addition to one or more of the features described above, or as an alternative, further embodiments may include that the kinked heat shield panel further includes a first surface, a second surface opposite the first surface, and a mounting stud located proximate the kink of the kinked heat shield panel and extending away from the second surface, and wherein the mounting stud is centered between the first lateral edge and the second lateral edge.

According to another embodiment, a kinked heat shield panel for use in a combustor of a gas turbine engine is provided. The kinked heat shield panel including: a first surface, a second surface opposite the first surface, and a mounting stud located proximate the kink of the kinked heat shield panel and extending away from the second surface; and a forward edge, a rearward edge opposite the forward edge, a first lateral edge, and a second lateral edge opposite the first lateral edge, wherein the first lateral edge and the second lateral edge extend from the forward edge to the rearward edge, and wherein the kink of the kinked heat shield panel extends from the first lateral edge to the second lateral edge.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

The detailed description explains embodiments of the present disclosure, together with advantages and features, by way of example with reference to the drawings.

DETAILED DESCRIPTION

A detailed description of one or more embodiments of the disclosed apparatus and method are presented herein by way of exemplification and not limitation with reference to the Figures.

Figure 1:
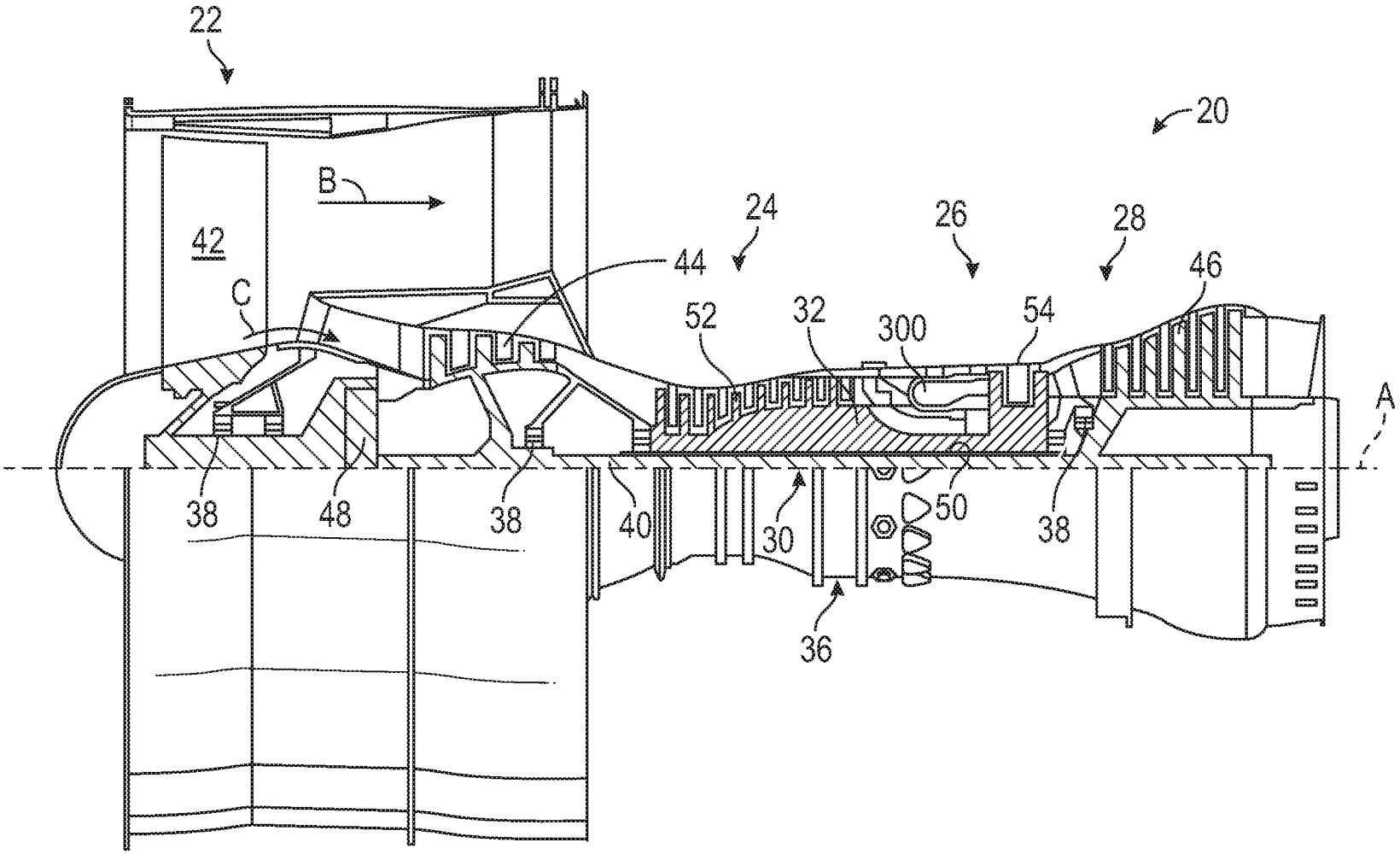
FIG. 1 is a partial cross-sectional illustration of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 300 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 300, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

Figure 2:
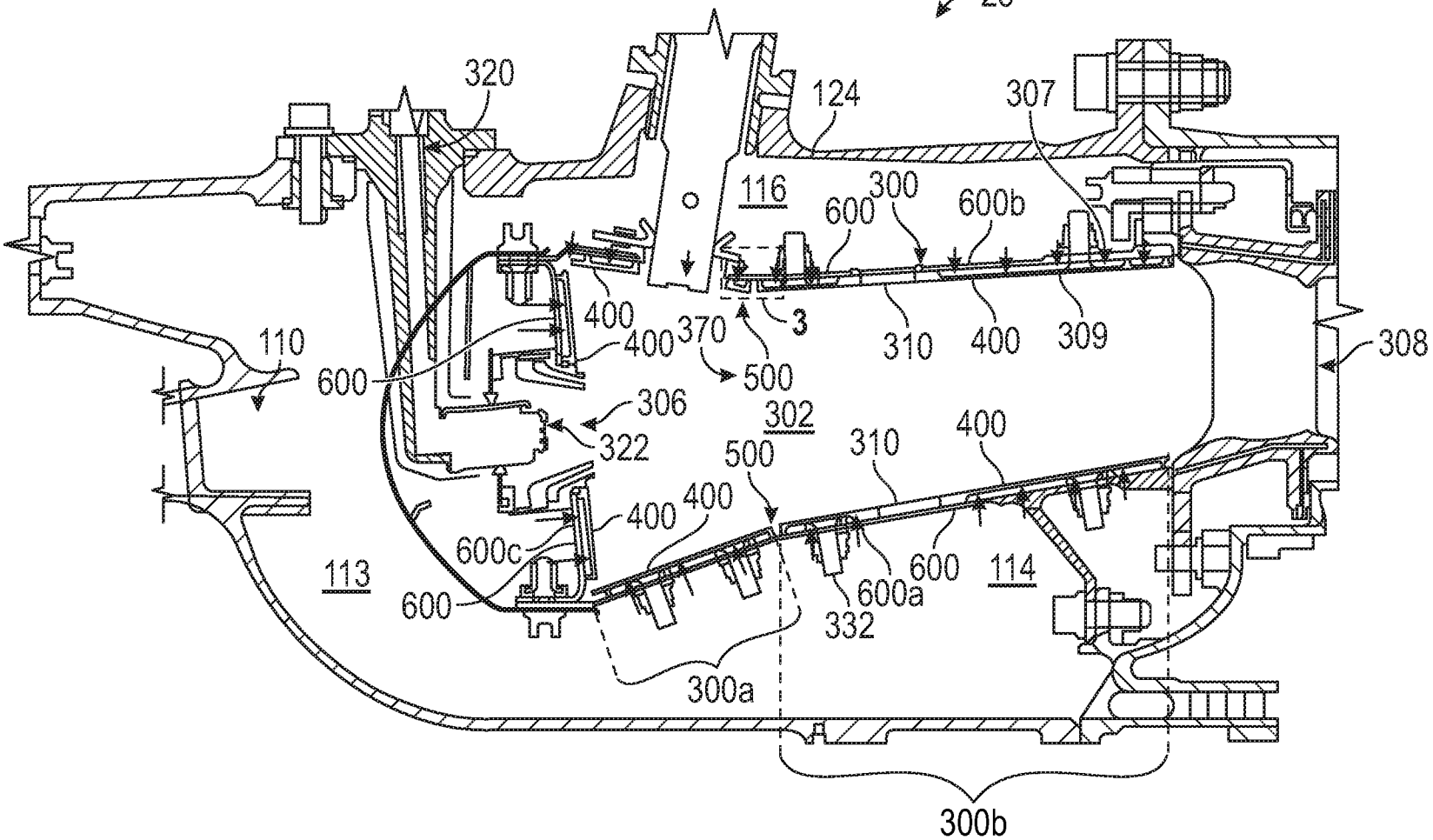
FIG. 2 (Prior Art)
FIG. 2 is a cross-sectional illustration of a combustor.

Referring now to FIG. 2 and with continued reference to FIG. 1, the combustor section 26 of the gas turbine engine 20 is shown. The combustor 300 of FIG. 2 is an impingement film float wall combustor. It is understood that while an impingement film float wall combustor is utilized for exemplary illustration, the embodiments disclosed herein may be applicable to other types of combustors for gas turbine engines including but not limited to double pass liner combustors and float wall combustors. As illustrated, a combustor 300 defines a combustion chamber 302. The combustion chamber 302 includes a combustion area 370 within the combustion chamber 302. The combustor 300 includes an inlet 306 and an outlet 308 through which air may pass. The air may be supplied to the combustor 300 by a pre-diffuser 110. Air may also enter the combustion chamber 302 through other holes in the combustor 300 including but not limited to quench holes 310, as seen in FIG. 2.

Compressor air is supplied from the compressor section 24 into a pre-diffuser 110, which then directs the airflow toward the combustor 300. The combustor 300 and the pre-diffuser 110 are separated by a dump region 113 from which the flow separates into an inner shroud 114 and an outer shroud 116. As air enters the dump region 113, a portion of the air may flow into the combustor inlet 306, a portion may flow into the inner shroud 114, and a portion may flow into the outer shroud 116.

The air from the inner shroud 114 and the outer shroud 116 may then enter the combustion chamber 302 by means of one or more impingement holes 307 in the shell 600 and one or more secondary apertures 309 in the heat shield panels 400. The impingement holes 307 and secondary apertures 309 may include nozzles, holes, etc. The air may then exit the combustion chamber 302 through the combustor outlet 308. At the same time, fuel may be supplied into the combustion chamber 302 from a fuel injector 320 and a pilot nozzle 322, which may be ignited within the combustion chamber 302. The combustor 300 of the engine combustion section 26 may be housed within diffuser cases 124 which may define the inner shroud 114 and the outer shroud 116.

Figure 3:
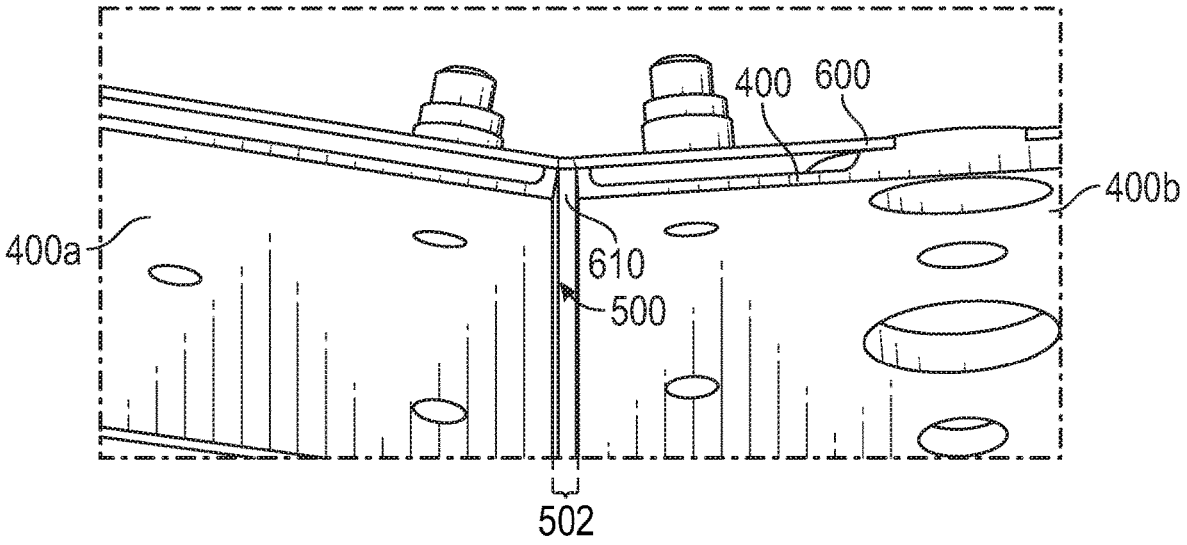
FIG. 3 (Prior Art)
FIG. 3 is an enlarged view of a kink in a shell of the combustor of FIG. 2.

The combustor 300, as shown in FIG. 2, includes multiple heat shield panels 400 that are attached to one or more shells 600 (See FIG. 3). The heat shield panels 400 may be arranged parallel to the shell 600. The shell 600 includes a radially inward shell 600*a* and a radially outward shell 600*b* in a facing spaced relationship defining the combustion chamber 300 therebetween. The shell 600 also includes a forward shell 600*c* extending between the radially inward shell 600*a* and the radially outward shell 600*b*. The forward shell 600*c* further bounds the combustion chamber 300 on a forward end. The radially inward shell 600*a* and the radially outward shell 600*b* extend circumferentially around the longitudinal engine axis A. The radial inward shell 600*a* is located radially inward from the radially outward shell 600*b*.

The heat shield panels 400 can be removably mounted to the shell 600 by one or more attachment mechanisms 332. In some embodiments, the attachment mechanism 332 may be integrally formed with a respective heat shield panel 400, although other configurations are possible. In some embodiments, the attachment mechanism 332 may be a threaded mounting stud or other structure that may extend from the respective heat shield panel 400 through the interior surface to a receiving portion or aperture of the shell 600 such that the heat shield panel 400 may be attached to the shell 600 and held in place. The heat shield panels 400 partially enclose a combustion area 370 within the combustion chamber 302 of the combustor 300.

Referring now to FIGS. 2 and 3, with continued reference to FIG. 1, a kink 500 in the shell 600 is illustrated, in accordance with an embodiment of the present disclosure. For example, the kink 500 may be a bend in the shell 600. The kink 500 is present in the radially inward shell 600*a* and the radially outward shell 600*b* in order to meet the volume and length requirement of combustor 300. The kink 500 is a junction of a first section 330*a* of the combustor 300 having a first coned shape and a second section 300*b* of the combustor 300 having a second coned shape. The first coned shape of the first section 300*a* is different from the second coned shape of the second section 300*b*, as shown in FIG. 3. The kink 500 is a point in the shell 600 at which the cross sectional area of the combustor 300 changes. Conventionally, as shown in FIG. 3 the nature of the kink 500 compels that there be two separate heat shield panels 400*a*, 400*b* forward and aft of the kink 500, as such there is a gap 502 formed between the two separate heat shield panels 400*a*, 400*b*. The kink 500 and the gap 502 extends circumferentially around the combustor 300. The gap 502 is located between a first heat shield panel 400*a* and a second heat shield panel 400*b*. The first heat shield panel 400*a* may be located forward of the gap 502 and the second heat shield panel 400*b* may be located aft gap 502. The gap 502 exposes an inner surface 610 of the shell 600 at the kink 500 to elevated temperatures within the combustion area 302. Excessive heat in the shell 600 at the area of the gap 502 may lead to oxidation, cracking, and high thermal stresses of the shell 600. Embodiments discussed herein seek to address this gap 502 proximate the kink 500 in the shell 600 by removing the gap 502 using a single kinked heat shield 400*c* (see FIG. 4).

Figure 4:
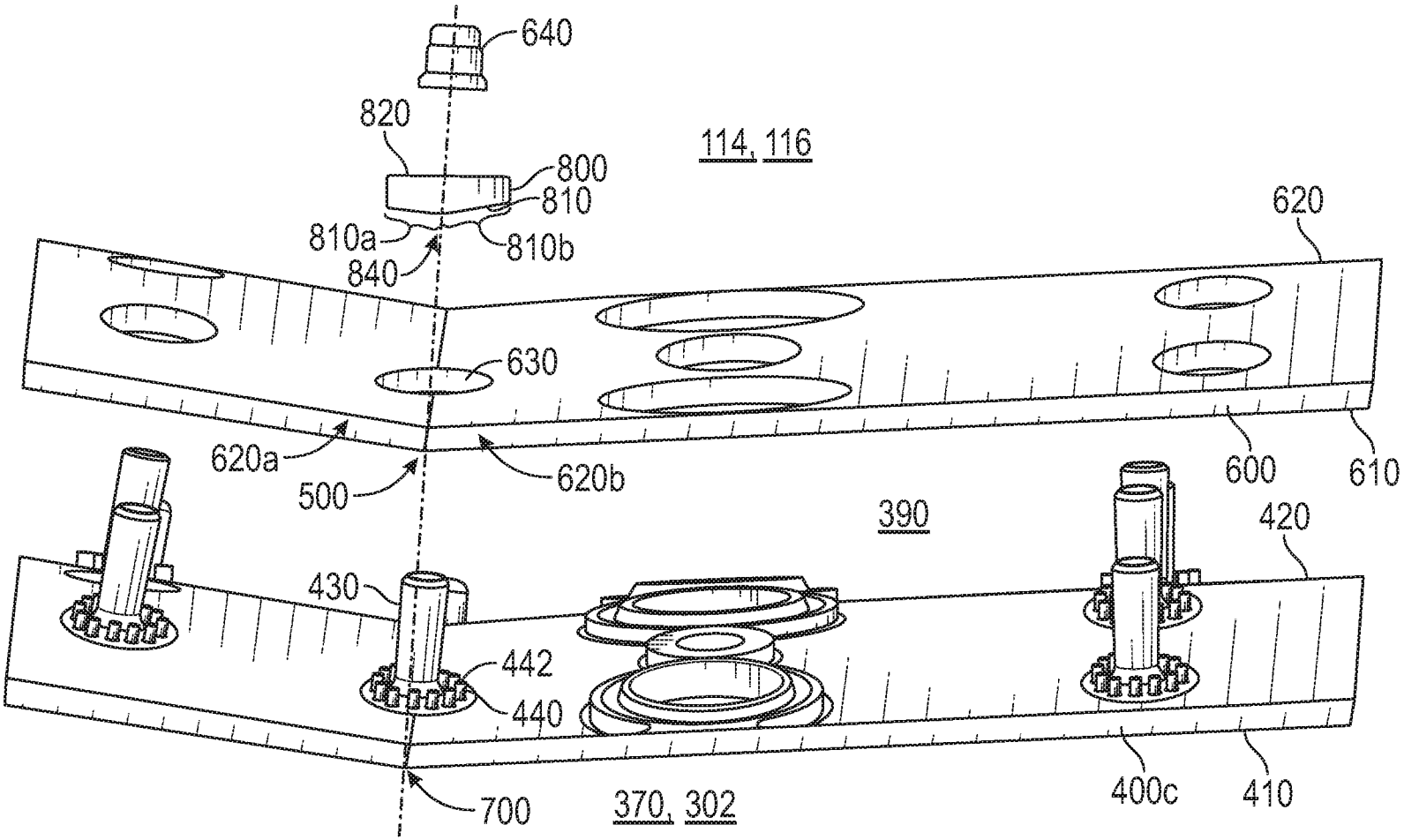
FIG. 4 is a view of a kinked heat shield panel and a shell for use in the combustor of FIG. 2, in accordance with an embodiment of the present disclosure.
Figure 5:
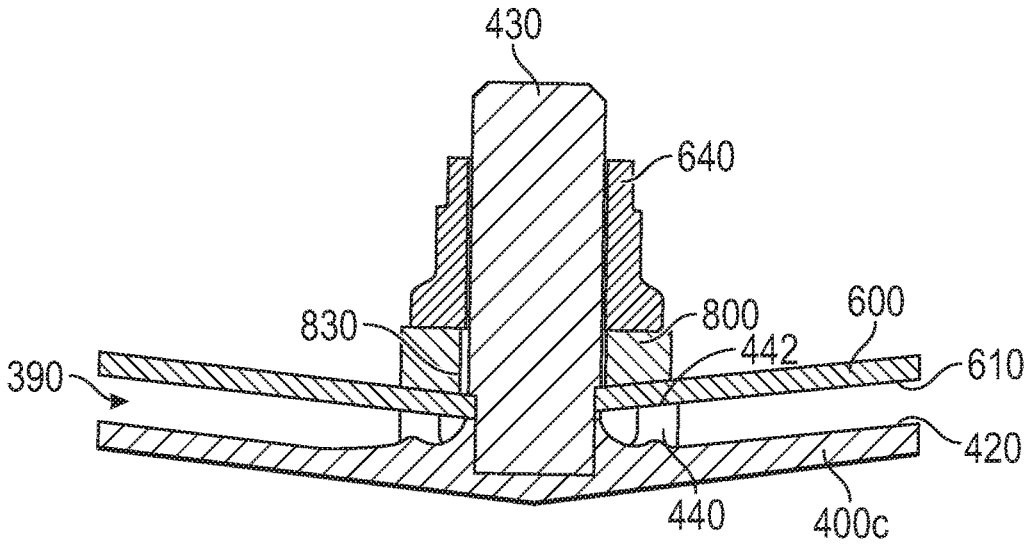
FIG. 5 is a cross-sectional view of the kinked heat shield panel, the shell, a kinked washer, and a nut, in accordance with an embodiment of the present disclosure.

Referring now to FIGS. 4 and 5, with continued reference to FIGS. 1-3, a kinked heat shield panel 400*c* is illustrated, in accordance with an embodiment of the present disclosure. The kinked heat shield 400*c* may be used in place of both the first heat shield panel 400*a* and the second heat shield panel 400*b* of FIG. 3, thus advantageously reducing part count by replacing two components (e.g., the first heat shield panel 400*a* and the second heat shield panel 400*b*) with one component (e.g., kinked heat shield 400*c*) and also eliminating the gap 502 proximate the kink 500. The kinked heat shield panel 400*c* includes a kink 700 located proximate the kink 500 of the shell 600. The kink 700 of the kinked heat shield panel 400*c* may be in a facing space relationship with the kink 500 of the shell 600.

The kinked heat shield panel 400*c* and the shell 600 are in a facing spaced relationship. The kinked heat shield panel 400*c* is about parallel to the shell 600. The kinked heat shield panel 400*c* includes a first surface 410 oriented towards the combustion area 370 of the combustion chamber 302 and a second surface 420 opposite the first surface 410 oriented towards the shell 600. The shell 600 has an inner surface 610 and an outer surface 620 opposite the inner surface 610. The inner surface 610 is oriented toward the kinked heat shield panel 400*c*. The outer surface 620 is oriented outward from the combustor 300 proximate the inner diameter branch 114 and the outer diameter branch 116.

The kinked heat shield panel 400*c* may include one or more mounting studs 430 configured to attach the kinked heat shield panel 400*c* to the shell 600. The mounting stud 430 extends outward away from the second surface 420 of the kinked heat shield panel 400*c*. The shell 600 may include one or more mounting orifices 630 extending through the shell 600 from the inner surface 610 to the outer surface 620. The mounting stud 430 is configured to extend through a mounting orifice 630 located opposite the mounting stud 430. When the mounting stud 430 is inserted through the mounting orifice 630 the kinked heat shield panel 400*c* may be secured to the shell 600 via a nut 640 and a kinked washer 800, as shown in FIG. 5. The nut 640 is configured to secure to the mounting stud 430. For example, the nut 640 may twist onto the mounting stud 430 via a mating thread system, which is not shown for simplification of illustration.

The kinked heat shield panel 400*c* may include a mounting stud 430 located proximate the kink 700 of the kinked heat shield panel 400*c*. The mounting stud 430 may be located at or on the kink 700 of the kinked heat shield panel 400*c*, as shown in FIG. 4. The shell 600 may include a mounting orifice 630 located proximate the kink 500 of the shell 600. The mounting orifice 630 may be located at or on the kink 500 of the shell 500, as shown in FIG. 4.

The kinked heat shield panel 400*c* may include one or more locating pins 440 proximate the mounting stud 430 located proximate the kink 700 of the kinked heat shield panel 400*c*. It is understood that mounting studs 430 not located proximate the kink 700 may also include locating pins. The locating pin 440 may be cylindrical in shape, as shown in FIGS. 4 and 5. The locating pin 440 includes a platform surface 442 operably shaped to conform to (i.e., match or mate flush with) the inner surface 610 of the shell 600 opposite the locating pin 440. The locating pin 440 maintains the height of the impingement cavity 390 between the kinked heat shield panel 400*c* and the shell 600. When the nut 640 is secured to the mounting stud 430 the kinked heat shield panel 400*c* is tightened and moves closer to the shell 600 until the inner surface 610 of the shell 600 sits flush with the platform surface 442 of the locating pin 440.

The kinked washer 800 includes receiving orifice 830 configured to allow the mounting stud 430 to pass through the receiving orifice 830. The kinked washer 800 includes a first surface 810 and a second surface 820 opposite the first surface 810. The receiving orifice 830 extends through the kinked washer 800 from the first surface 810 to the second surface 820. When assembled, the kinked washer 800 is located interposed between the nut 640 and the outer surface 620 of the shell 600. When assembled, the mounting stud 430 is located within the receiving orifice 830. The second surface 820 of the kinked washer 800 may be operably shaped to conform to (i.e., match or mate flush with) the nut 640. The first surface 810 of the kinked washer 800 includes a kink 840. The kink 840 in the first surface 810 of the kinked washer 800 is operably shaped to conform to (i.e., match or mate flush with) the outer surface 620 of the shell 600 at the kink 500 of the shell 600.

Further, the first surface 810 may include a first portion 810*a* and a second portion 810*b*. The first portion 810*a* may be located forward of the kink 840 and the second portion 810*b* may be located aft of the kink 840, as shown in FIG. 4. The second surface 620 of the shell 600 may include a first portion 620*a* and a second portion 620*b*. The first portion 620*a* may be located forward of the kink 500 and the second portion 620*b* may be located aft of the kink 500, as shown in FIG. 4. The first portion 810*a* of the first surface 810 of the kinked washer 800 may be operably shaped to conform to (i.e., match or mate flush with) the first portion 620*a* of the second surface 620 of the shell 600 proximate the kink 500. The second portion 810*b* of the first surface 810 of the kinked washer 800 may be operably shaped to conform to (i.e., match or mate flush with) the second portion 620*b* of the second surface 620 of the shell 600 proximate the kink 500.

Figure 6:
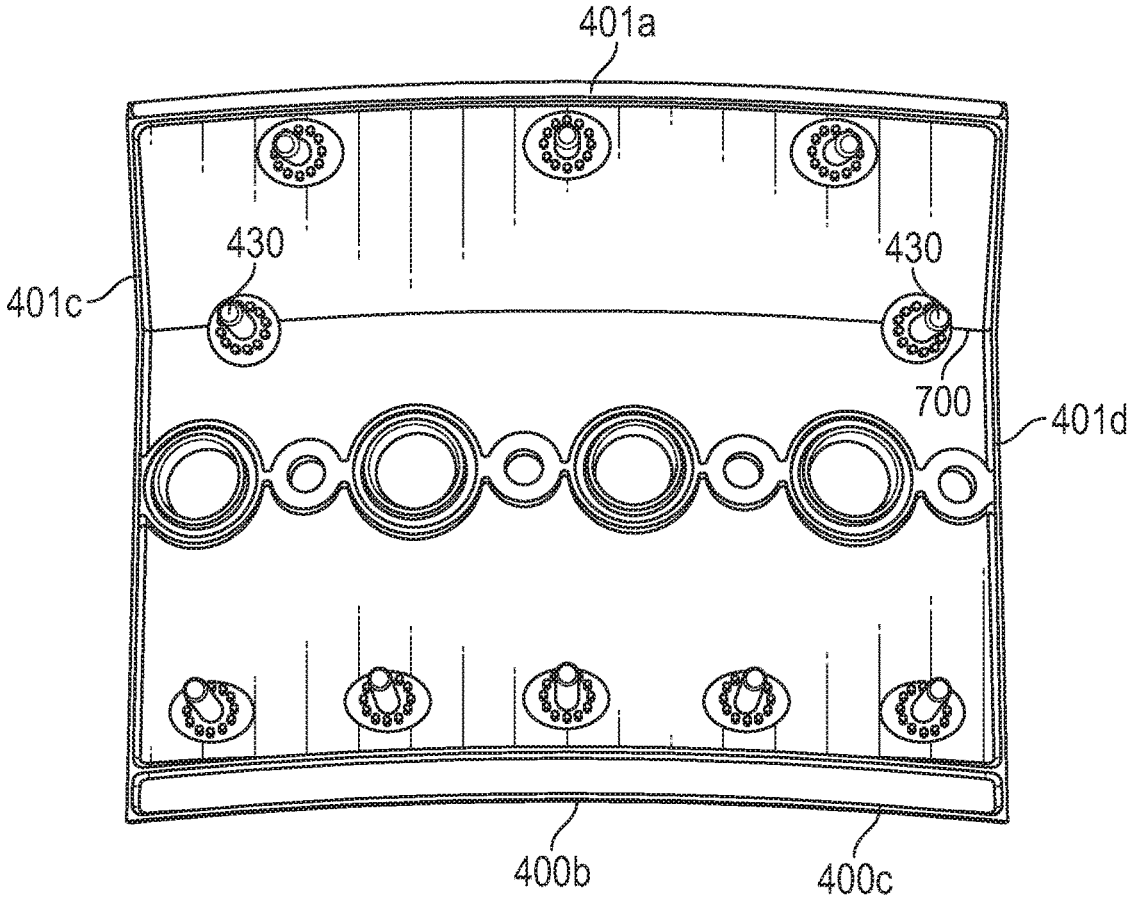
FIG. 6 is a top view of the kinked heat shield panel of FIGS. 4 and 5, in accordance with an embodiment of the present disclosure.

Referring now to FIG. 6, with continued reference to FIGS. 1-5, a top view of the kinked heat shield panel 400*c* is illustrated, in accordance with an embodiment of the present disclosure. The heat shield panel 400 is bounded on four sides by a forward edge 401*a*, a rearward edge 401*b* opposite the forward edge 401*a*, a first lateral edge 401*c*, and a second lateral edge 401*d* opposite the first lateral edge 401*c*. The first lateral edge 401*c* and the second lateral edge 401*d* extend from the forward edge 401*a* to the rearward edge 401*b*, as shown in FIG. 6. The kink 700 of the heat shield panel 400*c* extends from the first lateral edge 401*c* to the second lateral edge 401*d*, as shown in FIG. 6. The kink 700 of the heat shield panel 400*c* may extend from the first lateral edge 401*c* to the second lateral edge 401*d* about parallel to at least one of the forward edge 401*a* and the rearward edge 401*b*.

As shown in FIG. 6, there may be one or more mounting studs 430 located on the kink 700 of the kinked heat shield 400*c*. In the example illustrated in FIG. 6, there may be a mounting stud 430 located proximate the kink 700 and proximate the first lateral edge 401*c* and another mounting stud 420 located proximate the kink 700 and proximate the second lateral edge 401*d*. Advantageously, locating mounting studs 420 proximate the first lateral edge 401*c* and the second lateral edge 401*d* helps seals the first lateral edge 401*c* and the second lateral edge 401*d* proximate the kink 700 for cooling flow through the impingement cavity 390 (see FIG. 4). Although not shown in FIG. 6, there may an additional mounting stud 430 located proximate the kink 700 and about centered between the first lateral edge 401*c* and the second lateral edge 401*d*.

Figure 7:
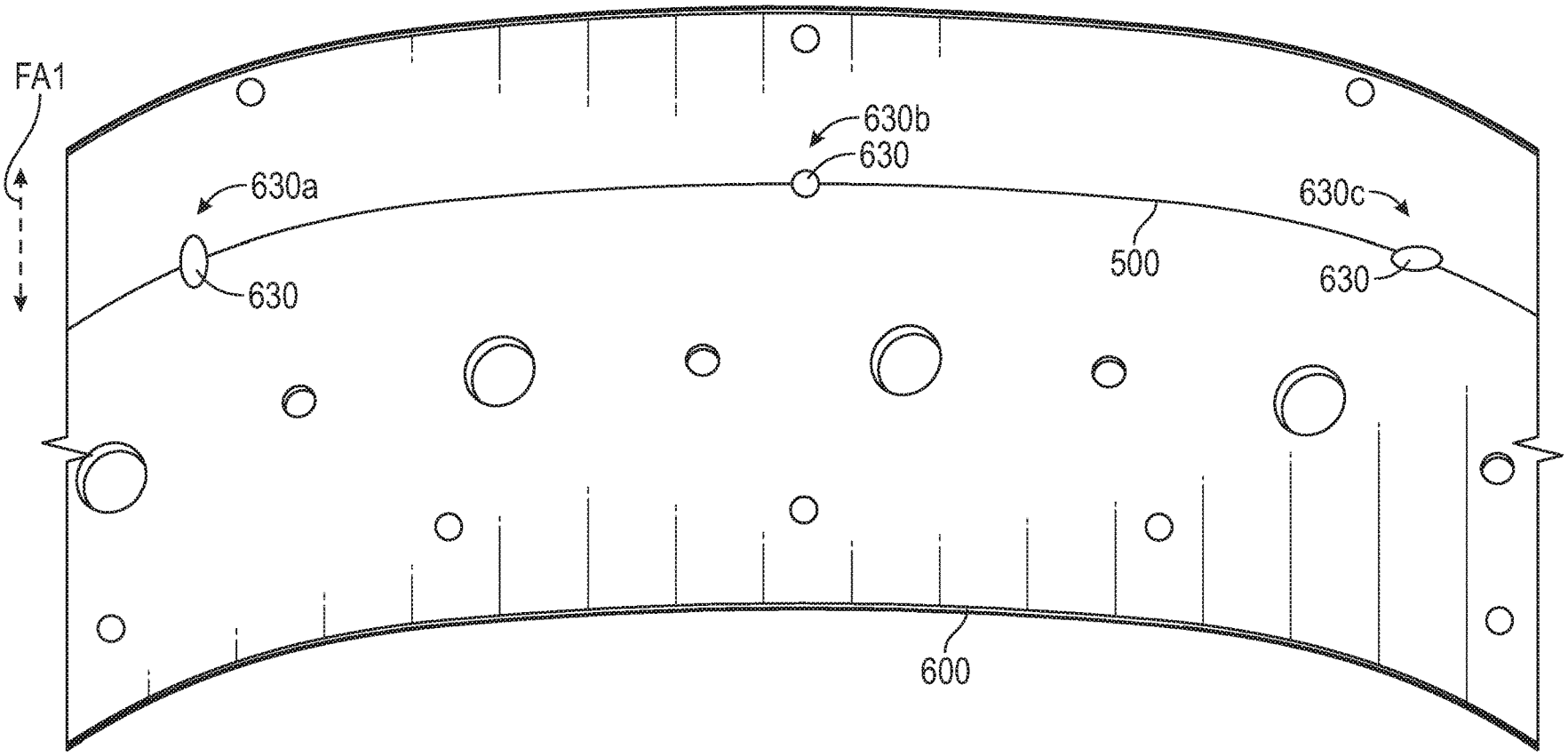
FIG. 7 is a top view of the shell of FIGS. 4 and 5, in accordance with an embodiment of the present disclosure.

Referring now to FIG. 7, with continued reference to FIGS. 1-6, a top view of the shell 600 is illustrated, in accordance with an embodiment of the present disclosure. Various shapes for the mounting orifices 630 located proximate the kink 500 in the shell 600 are illustrated in FIG. 7. In one embodiment, a mounting orifice 630 located proximate the kink 500 in the shell 600 may have an oval or slotted shape elongated in a forward-to-aft direction FA1, as shown at 630*a*, which allows the kinked heat shield panel 400*c* to expand in the forward-to-aft direction FA1 as a mounting stud 430 slides through the mounting orifice 630. In another embodiment, a mounting orifice 630 located proximate the kink 500 in the shell 600 may have an oval or slotted shape elongated perpendicular to the forward-to-aft direction FA1, as shown at 630*c*, which allows the kinked heat shield panel 400*c* to expand perpendicular to the forward-to-aft direction FA1 as a mounting stud 430 slides through the mounting orifice 630. In another embodiment, a mounting orifice 630 located proximate the kink 500 in the shell 600 may have an circular shape, as shown at 630*b*, which restricts the kinked heat shield panel 400*c* from moving proximate the mounting stud 430 that is located through the mounting orifice 630. It is understood that that location of the mounting orifices 630 along the kink 500, their respective shapes, and the combination of different shapes may vary. It is also understood that the mounting orifices 630 located away from the kink 500 are shown as circular for ease of illustration but may have other shapes, including but not limited to oval, slotted, . . . etc, and may have different heights, widths, and dimensions.

Technical effects of embodiments of the present disclosure include incorporating a kinked heat shield panel into a combustor to remove gaps previously located between heat shield panels located proximate to kinks in the shell of the combustor.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A combustor for use in a gas turbine engine, the combustor enclosing a combustion chamber having a combustion area, wherein the combustor comprises:

a shell having a kink, wherein the kink is a v-shaped bend; and a kinked heat shield panel in facing spaced relationship with the shell, the kinked heat shield panel including a kink located proximate the kink in the shell, wherein the kink in the heat shield panel is a v-shaped bend, wherein the kinked heat shield panel further comprises a first surface, a second surface opposite the first surface, and a mounting stud located proximate the kink of the kinked heat shield panel and extending away from the second surface, wherein the shell further comprises an inner surface, an outer surface opposite the inner surface, and a mounting orifice extending through the shell from the inner surface to the outer surface, the mounting orifice being located proximate the kink of the shell, and wherein the mounting orifice is located at or on the kink of the shell.

2. The combustor of claim 1, wherein the kinked heat shield panel is parallel to the shell.

3. The combustor of claim 1, wherein the combustor comprises a first section and a second section, wherein the kink of the shell is a junction of the first section of the combustor having a first coned shape and the second section of the combustor having a second coned shape.

4. The combustor of claim 1, wherein the kink of the shell is a point in the shell at which a cross sectional area of the combustor changes.

5. The combustor of claim 1, wherein the mounting stud is located at or on the kink of the kinked heat shield panel.

6. The combustor of claim 1, wherein the mounting orifice is located opposite the mounting stud.

7. The combustor of claim 1, wherein the kinked heat shield panel further comprises a forward edge, a rearward edge opposite the forward edge, a first lateral edge, and a second lateral edge opposite the first lateral edge, wherein the first lateral edge and the second lateral edge extend from the forward edge to the rearward edge, and wherein the kink of the kinked heat shield panel extends from the first lateral edge to the second lateral edge.

8. The combustor of claim 7, wherein the kink of the kinked heat shield panel extends from the first lateral edge to the second lateral edge parallel to at least one of the forward edge and the rearward edge.

9. The combustor of claim 8, wherein the kinked heat shield panel further comprises a locating pin located proximate the mounting stud and extending away from the second surface, wherein the locating pin further comprises a platform surface operably shaped to conform to the inner surface of the shell opposite the locating pin.

10. The combustor of claim 8, further comprising:

a nut secured to the mounting stud; and a kinked washer interposed between the nut and the outer surface of the shell, the kinked washer being operably shaped to conform to the outer surface of the shell proximate the kink of the shell.

11. The combustor of claim 10, wherein the kinked washer further comprises a first surface proximate the outer surface of the shell and a second surface opposite the first surface of the kinked washer, the second surface of the kinked washer being proximate the nut, and wherein the first surface of the kinked washer is operably shaped to conform to the outer surface of the shell proximate the kink of the shell.

12. The combustor of claim 11, wherein the second surface of the kinked washer is operably shaped to conform to the nut.

13. The combustor of claim 10, wherein the kinked washer further comprises a receiving orifice extending through the kinked washer from the first surface to the second surface, the mounting stud being located within the kinked orifice.

14. The combustor of claim 1, wherein the mounting orifice is circular, oval or slotted in shape.

15. The combustor of claim 7, wherein the mounting stud is located proximate at least one of the first lateral edge and the second lateral edge.

16. The combustor of claim 7, wherein the mounting stud is centered between the first lateral edge and the second lateral edge.

* * * * *